US006902034B2

(12) United States Patent
Gibson et al.

(10) Patent No.: US 6,902,034 B2
(45) Date of Patent: Jun. 7, 2005

(54) APPARATUS WITH UTILITY TRAY MOUNTED TO SCAFFOLD

(75) Inventors: William R. Gibson, Kent, OH (US); Jerry Larrison, Columbus, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/636,390

(22) Filed: Aug. 7, 2003

(65) Prior Publication Data

US 2004/0238278 A1 Dec. 2, 2004

Related U.S. Application Data

(60) Provisional application No. 60/473,840, filed on May 28, 2003.

(51) Int. Cl.[7] ..... E04G 1/00; E04G 1/34

(52) U.S. Cl. ..... 182/129; 182/152

(58) Field of Search ..... 182/129, 230, 182/107, 115–119, 152, 222, 33, 223, 161, 165, 214; 248/210, 238, 235; 108/118, 119, 115, 131, 26, 25; 206/372, 373

(56) References Cited

U.S. PATENT DOCUMENTS

| | | | | | |
|---|---|---|---|---|---|
| 2,003,581 | A | * | 6/1935 | Daly, Jr. | 108/116 |
| 3,700,072 | A | | 10/1972 | Lovett | |
| 3,739,876 | A | * | 6/1973 | Goldberg | 182/155 |
| 4,047,594 | A | | 9/1977 | Eisenberg | |
| 4,241,808 | A | | 12/1980 | Middleton et al. | |
| 4,298,096 | A | | 11/1981 | Prior | |
| 4,570,752 | A | | 2/1986 | Chapman et al. | |
| 4,640,385 | A | | 2/1987 | Underhill | |
| 4,645,162 | A | | 2/1987 | Roy et al. | |
| 4,690,248 | A | | 9/1987 | Killeen | |
| 4,705,247 | A | * | 11/1987 | Delmerico | 248/98 |
| 4,823,913 | A | | 4/1989 | Riegel, Jr. | |
| 4,880,080 | A | | 11/1989 | Brockman | |
| 5,031,723 | A | | 7/1991 | Hooten | |
| 5,082,249 | A | | 1/1992 | Havlovitz | |
| 5,096,019 | A | | 3/1992 | Kelsay | |
| 5,154,441 | A | * | 10/1992 | White et al. | 108/120 |
| 5,158,023 | A | * | 10/1992 | Allen | 108/42 |
| 5,191,954 | A | | 3/1993 | Ledford | |
| 5,275,256 | A | | 1/1994 | Ellzey | |
| 5,342,008 | A | | 8/1994 | Kay | |
| 5,358,070 | A | | 10/1994 | Bartnicki et al. | |
| 5,419,409 | A | | 5/1995 | Corulla | |
| 5,431,249 | A | | 7/1995 | Tredup | |
| 5,544,718 | A | | 8/1996 | Schumacher | |
| 5,622,463 | A | * | 4/1997 | Testa | 182/129 |
| 5,673,885 | A | | 10/1997 | Pham | |
| 5,722,507 | A | * | 3/1998 | Kain | 182/129 |
| 5,740,883 | A | | 4/1998 | Trank | |
| 5,758,744 | A | | 6/1998 | Forino | |
| 5,865,269 | A | | 2/1999 | Eskesen | |
| 5,913,380 | A | | 6/1999 | Gugel et al. | |
| 5,937,968 | A | | 8/1999 | Gibson et al. | |
| 5,954,156 | A | | 9/1999 | Cooke | |
| 5,967,259 | A | | 10/1999 | Williams | |
| 6,000,497 | A | | 12/1999 | Kain et al. | |
| 6,131,699 | A | | 10/2000 | Leak, Jr. | |
| 6,209,683 | B1 | | 4/2001 | Holtz | |
| 6,341,666 | B1 | | 1/2002 | Allen | |
| 6,390,238 | B1 | | 5/2002 | Gibson et al. | |
| 6,427,804 | B1 | | 8/2002 | Lazarus | |
| 6,427,805 | B1 | | 8/2002 | Gibson et al. | |
| 6,443,260 | B1 | | 9/2002 | Katz et al. | |
| 6,454,050 | B2 | | 9/2002 | Gibson et al. | |

(Continued)

OTHER PUBLICATIONS

Images of product from Tricam Industries (6 pages) (before May 28, 2003).

*Primary Examiner*—Hugh B. Thompson, II
(74) *Attorney, Agent, or Firm*—Barnes & Thornburg LLP

(57) ABSTRACT

An apparatus includes a scaffold and a utility tray. The utility tray is mounted to the scaffold.

26 Claims, 5 Drawing Sheets

U.S. PATENT DOCUMENTS

| | | | |
|---|---|---|---|
| 6,536,557 | B2 | 3/2003 | Gibson et al. |
| 6,550,579 | B2 | 4/2003 | Gibson et al. |
| 2002/0017430 | A1 | 2/2002 | Rosko |
| 2002/0166725 | A1 | 11/2002 | Gulledge |
| 2003/0029676 | A1 | 2/2003 | Gibson et al. |

* cited by examiner

APPARATUS WITH UTILITY TRAY MOUNTED TO SCAFFOLD

This application claims priority under 35 U.S.C. 119(e) to U.S. Provisional Application No. 60/473,840, filed May 28, 2003, which is hereby incorporated by reference herein.

BACKGROUND

The present disclosure relates to scaffolds.

Scaffolds are used by individuals for elevation. Elevation may be helpful when working in hard-to-reach areas.

SUMMARY

According to the present disclosure, an apparatus includes a scaffold, a utility tray, and a tray mount. The tray mount is mounted to the scaffold. The utility tray is mounted to the tray mount.

In one embodiment of the apparatus, the tray mount includes a collapsible tray stand. The tray stand is mounted to the scaffold for movement of the utility tray between a collapsed position in which the utility tray is positioned next to the scaffold for transport and storage of the apparatus and an upright position in which the utility tray is positioned at an elevation higher than the scaffold for use by a person on the scaffold. A stand lock is used to lock the tray stand to position the utility tray in the upright position.

The tray stand includes a first tray pivoter and a second tray pivoter. The first tray pivoter is mounted to the scaffold for pivotable movement of the utility tray relative to the scaffold between the collapsed and upright positions. The second tray pivoter is responsive to movement of the first tray pivoter to pivot the utility tray relative to the first tray pivoter to flip the tray over so that the utility tray is upside down in the collapsed position and rightside up in the upright position.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figure 1:
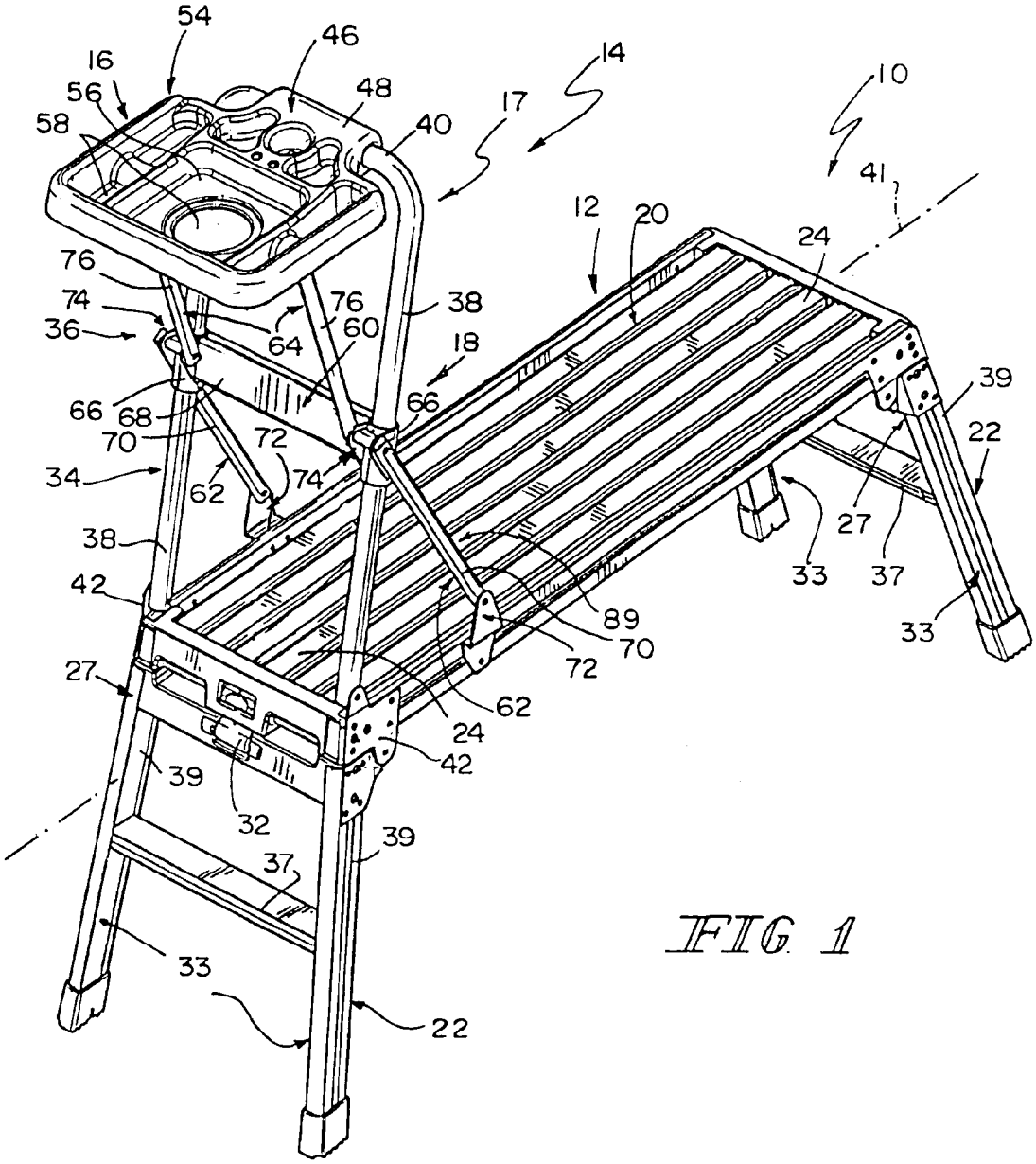
FIG. 1 is a perspective view of an apparatus including a scaffold and a utility tray unit including a tray mount configured as, for example, a collapsible tray stand mounted to a platform of the scaffold and supporting a utility tray in an upright position.
Figure 2:
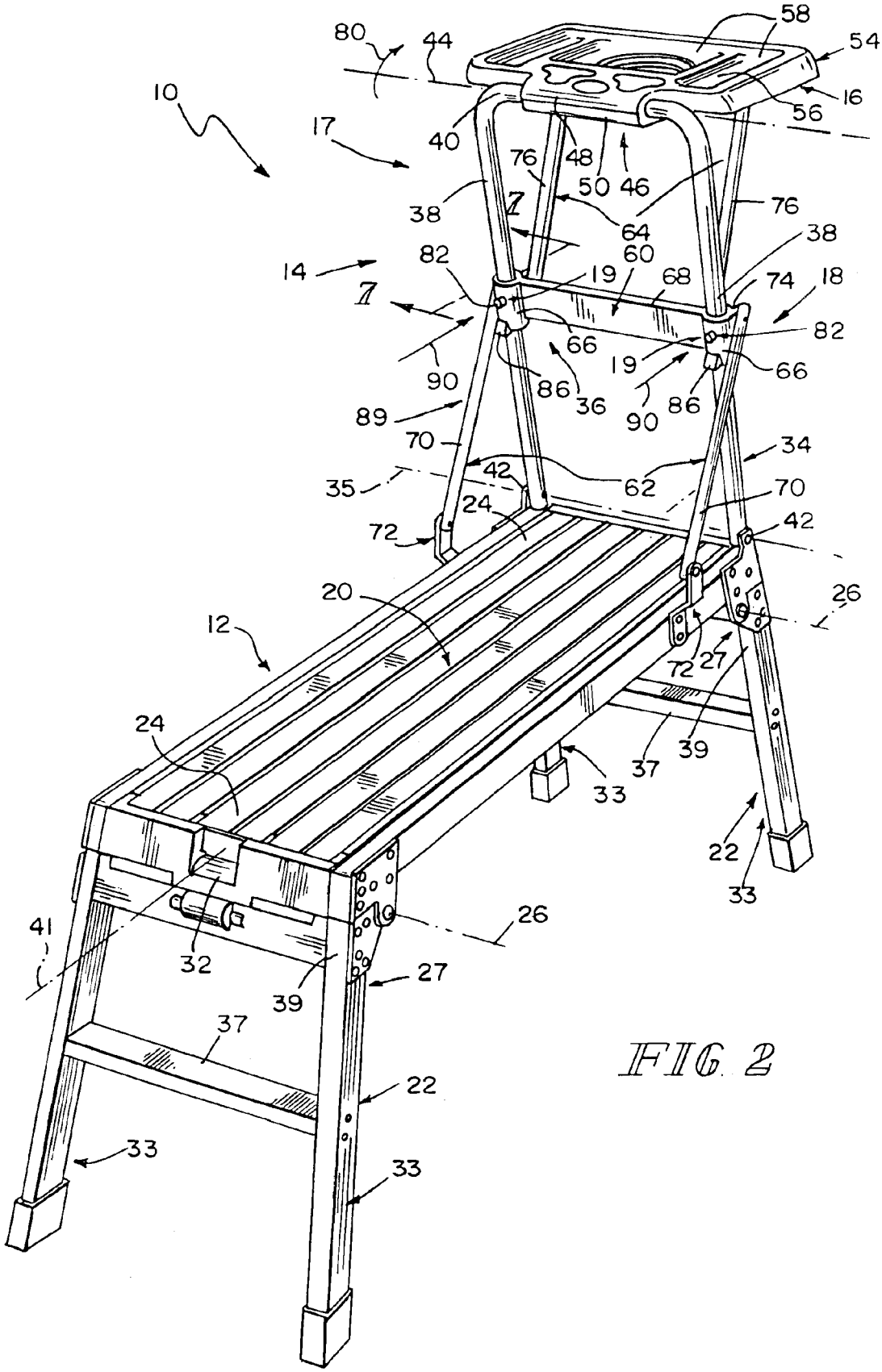
FIG. 2 is a perspective view of the apparatus showing the tray mount including a stand lock including a pair of releasable buttons that can be actuated to allow collapse of the tray stand and the utility tray mounted thereto toward the platform.

An apparatus 10 includes a scaffold 12 and a utility tray unit 14 mounted to scaffold 12, as shown in FIGS. 1 and 2. Utility tray unit 14 includes a utility tray 16 and a tray mount 17 to which utility tray 16 is mounted. Tray mount 17 is mounted to scaffold 12 for pivotable movement of utility tray 16 between upright position shown in FIGS. 1 and 2 in which the utility tray 16 is elevated higher than scaffold 12 for use by a person on scaffold 12 and a collapsed position shown in FIG. 4 in which utility tray 14 is positioned next to scaffold 12 for transport and storage of apparatus 10.

Figure 3:
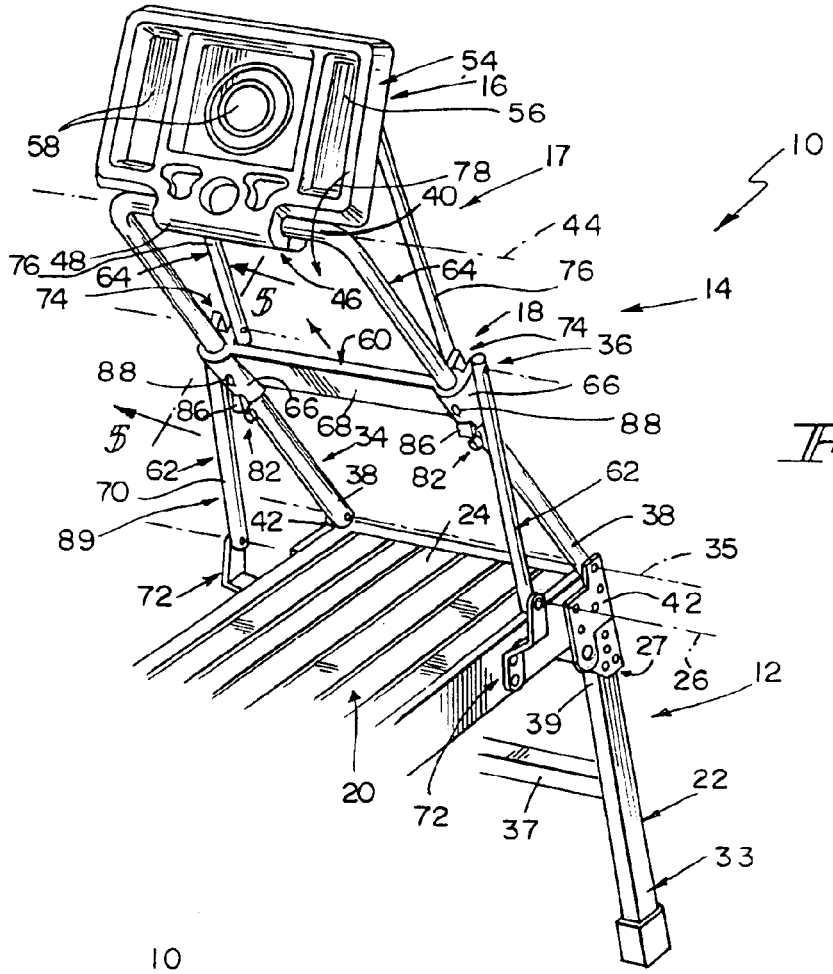
FIG. 3 is a perspective view of the apparatus, with portions broken away, showing collapse of the tray stand and the utility tray.
Figure 4:
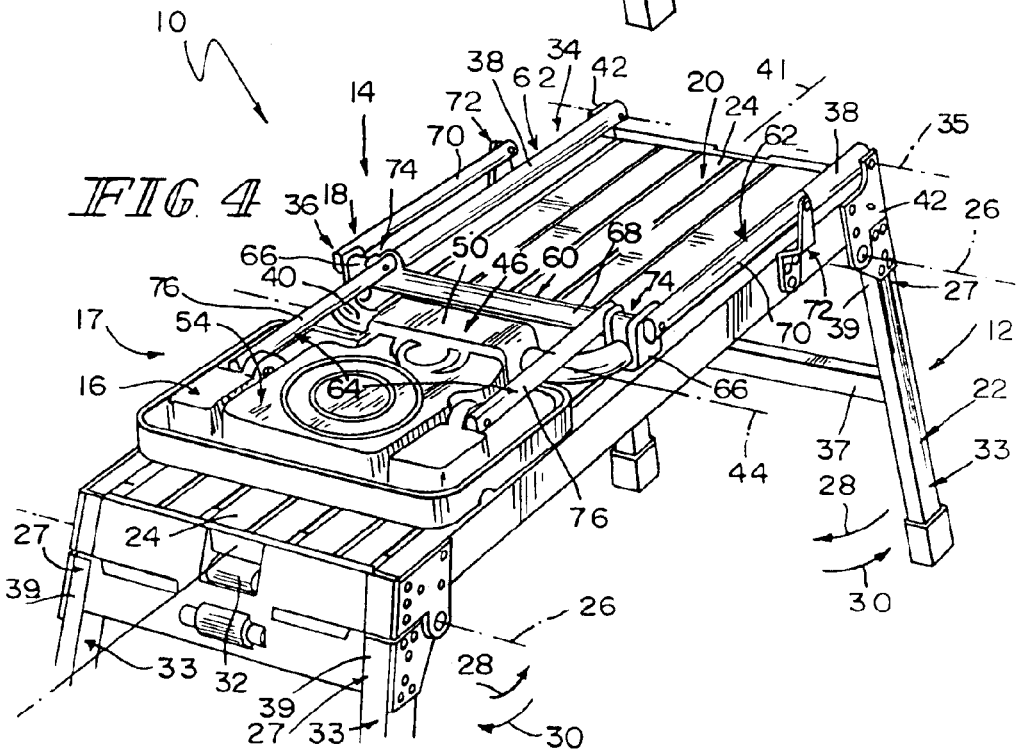
FIG. 4 is a perspective view of the apparatus, with portions broken away, showing the tray stand and the utility tray in a collapsed position.

Scaffold 12 includes a platform 20 and a pair of foldable leg units 22, as shown in FIGS. 1, 2, and 4. Platform 20 is configured to a support a person thereon in an elevated position. Platform 20 is longer than it is wide so as to have longitudinal end portions 24. A top portion 27 of each leg unit 22 is mounted to one of longitudinal end portions 24 for pivotable movement of leg unit 22 relative to platform 20 about a leg pivot axis 26 in a leg folding direction 28 to a folded position for transport and storage of apparatus 10 and in a leg unfolding direction 30 to an unfolded position for use of apparatus 10. Leg units 22 are shown in the unfolded position in FIGS. 1–4.

Scaffold includes a pair of leg locks 32, as shown in FIGS. 1, 2, and 4. Each leg lock 32 is mounted to lock one of leg units 22 in the unfolded position.

Each leg unit 22 includes a pair of legs 33 and a step 37 mounted to legs 33, as shown in FIGS. 1 and 2. A leg top portion 39 of each leg 33 is mounted to platform 20 for pivotable movement.

Tray mount 17 includes a collapsible stand 18 shown in FIGS. 1–4 and a stand lock 19 shown in FIG. 2. Tray stand 18 is arranged to move utility tray 16 relative to scaffold 12 between an upright position shown in FIGS. 1 and 2 and a collapsed position shown in FIG. 4. In the upright position, tray stand 18 positions utility tray 16 at an elevation higher than scaffold 12 for use of utility tray 16 by a person on platform 20. In the collapsed position, tray stand 18 positions utility tray 16 next to platform 20 for transport and storage of apparatus 10. Stand lock 19 is arranged to block movement of tray stand 18 to lock tray stand 18 to position utility tray 16 in the upright position.

Tray stand 18 includes a first tray pivoter 34 and a second tray pivoter 36, as shown in FIGS. 1–4. First tray pivoter 34 is arranged to pivot utility tray 16 relative to scaffold 12 between the collapsed and upright positions. Second tray pivoter 36 is responsive to movement of first tray pivoter 34 to pivot utility tray 16 relative thereto first tray pivoter 34 to flip utility tray 16 over such that it is upside down in the collapsed position and rightside up in the upright position.

First tray pivoter 34 is mounted to a longitudinal end portion 24 of platform 20 for pivotable movement relative to platform 20 about a stand pivot axis 35 which is perpendicular to a longitudinal axis 41 of platform 20, as suggested in FIG. 3. Utility tray 16 is mounted to first tray pivoter 34 to be carried thereby between the collapsed and upright positions during pivotable movement of first tray pivoter 34.

In the illustrated embodiment, first tray pivoter 34 is a frame including a pair of parallel slide rails 38 and a tray pivot mount 40, as shown in FIGS. 1–4. A proximal end portion of each slide rail 38 is mounted to a longitudinal end portion 24 of platform 20 by a rail pivot mount 42. Tray pivot mount 40 is mounted to a distal end portion of each slide rail 38 so as to extend between slide rails 38. Slide rails 38 and tray pivot mount 40 cooperate so that first tray pivoter 34 is U-shaped.

Figure 8:
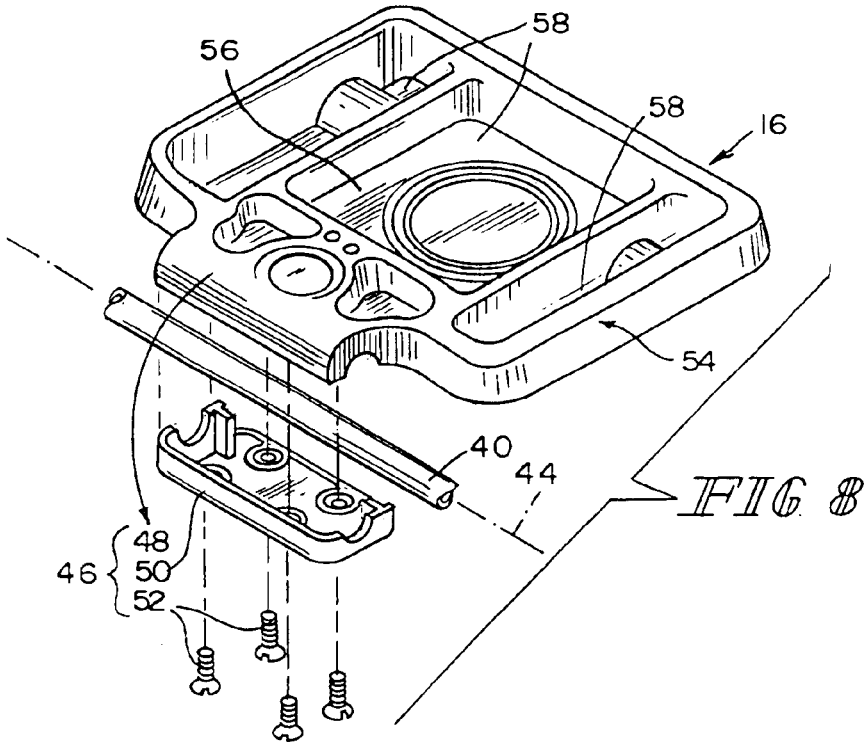
FIG. 8 is an exploded perspective view of the utility tray.

Utility tray 16 is mounted to tray pivot mount 40 for pivotable movement relative thereto about a tray pivot axis 44, as shown in FIGS. 1–4. Utility tray 16 includes a mount receiver 46, as shown best in FIG. 8. Mount receiver portion 46 includes a first receiver portion 48 and a second receiver portion 50 that are coupled together by fasteners 52 and cooperate to surround tray pivot mount 40 for pivotable movement of tray 16 thereon.

Figure 9:
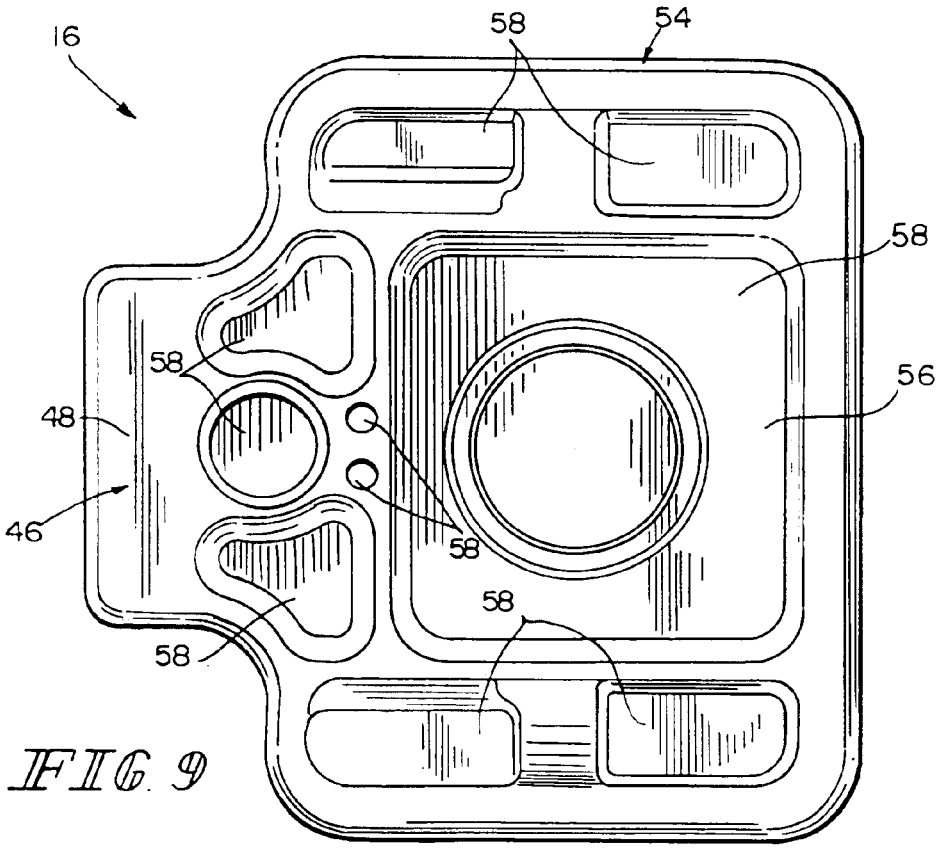
FIG. 9 is a top plan view of the utility tray.

Utility tray 16 includes a receptacle portion 54 mounted to mount receiver 46, as shown best in FIG. 9. Receptacle portion 54 includes an upper receptacle surface 56 formed to include a number of receptacles 58 of varying shapes and sizes.

Second tray pivoter 36 includes a slider 60, a slider mover 62, and a motion converter 64, as shown in FIGS. 1–4. Slider 60 is mounted to move along slide rails 38. Slider mover 62 is arranged to move slider 60 along slide rails 38 in response to pivotable movement of first tray pivoter 34 about stand pivot axis 35. Motion converter 64 is arranged to convert movement of slider along slide rails 38 into pivotable movement of utility tray 16 about tray pivot axis 44. In the illustrated embodiment, second tray pivoter 36 is a linkage and slider 60, slider mover 62 and motion converter 64 provide portions of the linkage.

Slider 60 includes a pair of slider sleeves 66 and a sleeve movement coordinator 68, as shown in FIGS. 1–4. Each slider sleeve 66 surrounds one of slide rails 38 so as to be mounted thereto for movement therealong. Sleeve movement coordinator 68 coordinates movement of slider sleeves 66 so that slider sleeves 66 move with one another along slide rails 38. In the illustrated embodiment, sleeve movement coordinator 68 is a bar mounted to and extending between slider sleeves 66.

Slider mover 62 includes a pair of links 70, as shown in FIGS. 1–4. Each link 70 is mounted to platform 20 by a first link pivot mount 72 for pivotable movement and to a second link pivot mount 74 for pivotable movement. Each first link pivot mount 72 is mounted to platform 20 between longitudinal end portions 24 thereof. Each second link pivot mount 74 is mounted to one of the slider sleeves 66 for movement therewith.

Motion converter 64 includes a pair of links 76, as shown in FIGS. 1–4. Each link 76 is mounted to one of second link pivot mounts 74 for pivotable movement and receptacle portion 54 of utility tray 16 for pivotable movement.

When first tray pivoter 34 pivots about stand pivot axis 35 from the upright position to the collapsed position, links 70 are pivoted so as to cause slider 60 to move toward tray pivot mount 40, as suggested in FIG. 3. Movement of slider 60 toward tray pivot mount 40 causes links 76 to pivot utility tray 16 about tray pivot axis 44 about 180° in direction 78 shown in FIG. 3 to flip utility tray 16 over to its collapsed position. In the collapsed position, receptacle surface 56 faces downwardly toward platform 20 as shown in FIG. 4.

When first tray pivoter 34 pivots about stand pivot axis 35 from the collapsed position to the upright position, links 70 are pivoted in the opposite direction so as to cause slider 60 to move away from tray pivot mount 40. Movement of slider 60 away from tray pivot mount 40 causes links 76 to pivot utility tray 16 about tray pivot axis 44 about 180° in direction 80 shown in FIG. 2 to flip utility tray 16 back over to its upright position. In the upright position, receptacle surface 56 faces upwardly away from platform 20 as shown in FIGS. 1 and 2.

Figure 5:
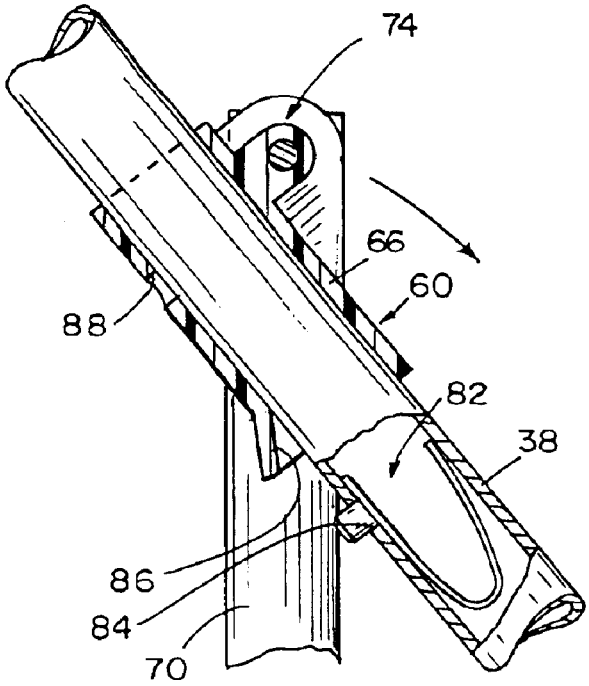
FIG. 5 is a sectional view taken along lines 5—5 of FIG. 3 showing a sleeve of a slider moving along a slide rail toward a spring-biased button mounted to the slide rail during movement of the tray stand and utility tray from the collapsed position to the upright position.
Figure 6:
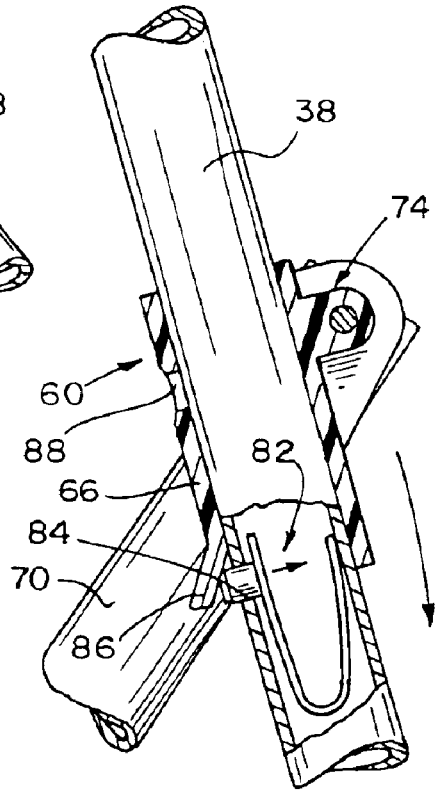
FIG. 6 is a sectional view similar to FIG. 5 showing retraction of the button due to engagement between the button and a cam mounted to the slider sleeve.
Figure 7:
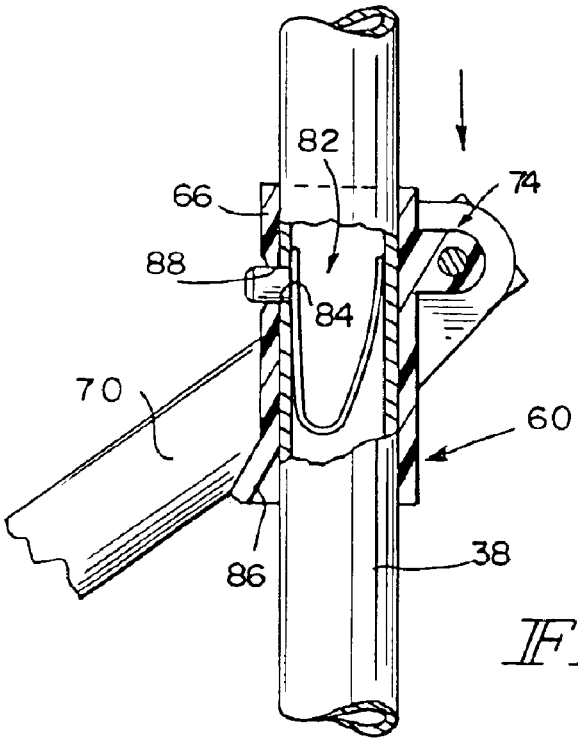
FIG. 7 is a sectional view taken along lines 7—7 of FIG. 2 showing reception of the spring-biased button in a button receiver formed in the slider sleeve to lock the tray stand and the utility tray in the upright position.

Stand lock 19 includes a pair of slider blockers 82, one of which is shown in FIGS. 5–7. Each slider blocker 82 is mounted to a slide rail 38 to block movement of slider 60 therealong to lock stand 18 and thus tray 16 in the upright position. In the illustrated embodiment, each slider blocker 82 is a releasable spring-biased button arranged to extend through a slide aperture 84 formed in the companion slide rail 38.

A cam 86 is mounted to each slider sleeve 66 for movement therewith, as shown in FIGS. 5–7. Each button 82 is arranged to engage one of the cams 86 during pivotable movement of first tray pivoter 34 to the upright position, as shown in FIG. 6. Engagement between button 82 and cam 86 retracts button 82 through aperture 84 into slide rail 38 until slide aperture 84 becomes aligned with a button receiver 88 formed in slider sleeve 66. In the illustrated embodiment, button receiver 88 is an aperture formed in slider sleeve 66. Slide aperture 84 becomes aligned with button receiver aperture 88 for reception of button 82 when first tray pivoter 34 assumes the upright position, as shown in FIG. 7.

Extension of button 82 through button receiver aperture 88 blocks movement of slider 60 on slide rail 38. When slider 60 is unable to move on slide rail 38, links 70 and links 76 are blocked from pivotable movement so that tray stand 18 and tray 16 are locked in the upright position.

To unlock stand 18 for movement of tray 16 to the collapsed position, an actuation force 90 is applied to each button 82 to retract buttons 82 into slide rails 38, as suggested in FIG. 2. Retraction of buttons 82 into slide rails 38 allows slider sleeves 66 to pass over buttons 82 and move along slide rails 38 for movement of tray stand 18 and utility tray 16 to the collapsed position.

Tray mount 17 provides means for mounting utility tray 16 to a first of the longitudinal end portions 24 for pivotable movement of utility tray 16 relative to platform 20 about a first pivot axis 35 between an upright position in which utility tray 16 is elevated higher than the scaffold 12 for use of utility tray 16 by a person on platform 20 and a collapsed position in which utility tray 16 is positioned next to second of the longitudinal end portions 24 and for pivotable movement of utility tray 16 about a second pivot axis 44 to flip utility tray 16 over in response to pivotable movement of utility tray 16 about first pivot axis 35 between the upright and collapsed positions.

What is claimed is:

1. An apparatus comprising a scaffold including a platform and a pair of leg units, the platform is longer than it is wide so as to include first and second longitudinal end portions, each leg unit is mounted to one of the longitudinal end portions, a utility tray, and means for mounting the utility tray to the first longitudinal end portion for pivotable movement of the utility tray relative to the platform about a first pivot axis between an upright position in which the utility tray is elevated higher than the scaffold for use of the utility tray by a person on the platform and a collapsed position in which the utility tray is positioned next to the second longitudinal end portion and for pivotable movement of the utility tray about a second pivot axis to flip the utility tray over in response to pivotable movement of the utility tray about the first pivot axis between the upright and collapsed positions.

2. The apparatus of claim 1, wherein the mounting means includes a tray stand and a stand lock, the tray stand is arranged to move to pivot the utility tray about the first and second pivot axes, and the stand lock is arranged to block movement of the tray stand to lock the tray stand to position the utility tray in the upright position.

3. The apparatus of claim 2, wherein the tray stand includes slide rail mounted to the first longitudinal end portion for pivotable movement about the first pivot axis, a tray pivot mount to which the tray is mounted for pivotable movement about the second pivot axis, a slider mounted to the slide rail, a slider mover mounted to the platform and the slider to move the slider along the slide rail upon pivotable movement of the slide rail about the first pivot axis, and a motion converter mounted to the slider and the utility tray to convert movement of the slider along the slide rail into pivotable movement of the utility tray about the second pivot axis.

4. The apparatus of claim 3, wherein the slider includes a button receiver and the stand lock includes a spring-biased button mounted to the slide rail for reception in the button receiver to lock the tray stand.

5. The apparatus of claim 3, wherein the slider mover includes a link mounted to the platform and the slider and the motion converter includes a link mounted to the slider and the utility tray.

6. The apparatus of claim 1, wherein the utility tray includes a receptacle surface formed to include at least one receptacle, the receptacle surface faces upwardly away from the platform in the upright position and faces downwardly toward the platform in the collapsed position.

7. An apparatus comprising a scaffold including a platform and a pair of leg units mounted to the platform, a utility tray including a ton side formed to include a receptacle portion and an opposite bottom side, and a tray mount to which the utility tray is mounted, the tray mount being mounted to the platform for pivotable movement relative thereto to pivot the utility tray between an upright position in which the utility tray is elevated higher than the scaffold for use by a person on the platform and the ton side is arranged to face away from the platform and a collapsed position in which the utility tray is positioned next to the platform and the ton side is arranged to face toward the platform.

8. The apparatus of claim 7, wherein the platform is longer than it is wide so as to have a platform longitudinal axis, the tray mount is pivotable about a pivot axis to pivot the utility tray between the upright and collapsed positions, and the pivot axis is perpendicular to the platform longitudinal axis.

9. An apparatus comprising a scaffold including a platform and a pair of leg units mounted to the platform, a utility tray, and a tray mount to which the utility tray is mounted, the tray mount being mounted to the platform for pivotable movement relative thereto to pivot the utility tray between an upright position in which the utility tray is elevated higher than the scaffold for use by a person on the platform and a collapsed position in which the utility tray is positioned next to the platform, wherein the tray mount includes a collapsible tray stand including a first tray pivoter and a second tray pivoter, the first tray pivoter is mounted to the platform for pivotable movement relative thereto about a stand pivot axis to pivot the utility tray about the stand pivot axis between the upright and collapsed positions, and the second tray pivoter is arranged to pivot the utility tray relative to the first tray pivoter about a tray pivot axis to flip the utility tray over in response to pivotable movement of the first tray pivoter.

10. The apparatus of claim 9, wherein the first tray pivoter includes a slide rail pivotable about the stand pivot axis and the second tray pivoter includes a slider mounted to the slide rail, a slider mover mounted to the platform and the slider to move the slider along the slide rail upon pivotable movement of the slide rail, and a motion converter mounted to the slider and the utility tray to convert movement of the slider along the slide rail into pivotable movement of the utility tray about the tray pivot axis.

11. The apparatus of claim 10, wherein the slider mover includes a first link mounted to the scaffold and the slider and the motion converter includes a second link mounted to the slider and the utility tray.

12. The apparatus of claim 10, wherein the platform is longer than it is wide so as to include first and second longitudinal end portions, the slide rail is mounted to the first longitudinal end portion, and the slider mover includes a link mounted to the platform between the first and second longitudinal end portions.

13. The apparatus of claim 10, wherein the slider includes a slider sleeve mounted to the slide rail and a cam mounted to the slider sleeve, the slider sleeve is formed to include a button receiver, and the tray mount includes a spring-biased button mounted to the slide rail to engage the cam for reception in the button receiver upon movement of the slider sleeve along the slide rail due to pivotable movement of the slide rail.

14. The apparatus of claim 13, wherein the first tray pivoter includes a tray pivot mount to which the utility tray is mounted for pivotable movement about the tray pivot axis and the slider is arranged to move along the slide rail toward the tray pivot mount upon movement of the utility tray to the collapsed position.

15. An apparatus comprising a scaffold including a platform and a pair of leg units mounted to the platform, a utility tray, and a tray mount to which the utility tray is mounted, the tray mount being mounted to the platform for pivotable movement relative thereto to pivot the utility tray between an upright position in which the utility tray is elevated higher than the scaffold for use by a person on the platform and a collapsed position in which the utility tray is positioned next to the platform, wherein the platform is longer than it is wide so as to have a platform longitudinal axis, the tray mount is pivotable about a pivot axis to pivot the utility tray between the upright and collapsed positions, and the pivot axis is perpendicular to the platform longitudinal axis, wherein the platform includes first and second longitudinal end portions, each leg unit is mounted to one of the longitudinal end portions, and the tray mount is mounted to the first longitudinal end portion for pivotable movement about the pivot axis to pivot the utility tray toward and away from the second longitudinal end portion.

16. An apparatus comprising a scaffold including a platform and a pair of leg units, the platform is longer than it is wide so as to include first and second longitudinal end portions, each leg unit is mounted to one of the longitudinal end portions, a utility tray unit including a utility tray and a tray mount, the tray mount including a collapsible tray stand and a stand lock, the tray stand being mounted to the first longitudinal end portion for pivotable movement to pivot the utility tray relative to the platform between an upright position in which the utility tray is elevated higher than the scaffold for use by a person on the platform and a collapsed position in which the tray stand extends from the first longitudinal end portion toward the second longitudinal end portion to position the utility tray next to the second longitudinal end portion, and the stand lock is arranged to block pivotable movement of the tray stand when the utility tray is positioned in the upright position.

17. The apparatus of claim 16, wherein the tray stand includes a frame and a linkage, the utility tray is mounted to the frame, the frame is mounted to the first longitudinal end portion for pivotable movement, and the linkage is mounted to the platform between the first and second longitudinal end portions, the frame, and the utility tray for pivotable movement of the utility tray relative to the frame in response to pivotable movement of the frame.

18. The apparatus of claim 17, wherein the frame includes a pair of parallel slide rails and a tray pivot mount extending therebetween, the slide rails are mounted to the first longitudinal end portion for pivotable movement relative to the platform, and the utility tray is mounted to the tray pivot mount for pivotable movement relative thereto.

19. The apparatus of claim 18, wherein the linkage includes a slider including a slider sleeve mounted to move along each slide rail and a sleeve movement coordinator arranged to coordinate movement of the slider sleeves along the slide rails so that the slider sleeves move along the slide rails in concert with one another and the linkage includes a link mounted to each sleeve and the platform between the first and second longitudinal end portions and includes a link mounted to each sleeve and the utility tray.

20. The apparatus of claim 19, wherein the stand lock includes a spring-biased button mounted to each slide rail for engagement with the slider sleeve mounted thereto to block movement of the slider on the slide rails when the utility tray assumes the upright position.

21. The apparatus of claim 18, wherein the slide rails and the tray pivot mount cooperate so that the frame is U-shaped.

22. The apparatus of claim 16, wherein the tray stand includes a slide rail and a slider arranged to move along the slide rail.

23. The apparatus of claim 16, wherein the tray lock includes a releasable button biased to block movement of the tray stand when the utility tray assumes the upright Position.

24. The apparatus of claim 16, wherein the tray stand is arranged to flip the utility tray over during movement of the utility tray between the collapsed and upright position.

25. An apparatus comprising a scaffold including a platform, at least one step and a pair of leg units mounted to the platform, wherein the at least one step is located substantially midway from the platform to a lower end of one of the leg units, a utility tray, and a tray mount to which the utility tray is mounted, the tray mount being mounted to the platform for pivotable movement relative thereto to pivot the utility tray between an upright position in which the utility tray is elevated higher than the scaffold for use by a person on the platform and a collapsed position in which the utility tray is positioned next to the platform wherein the at least one step is coupled to the scaffold to enable stepping onto the step then up onto the platform.

26. An apparatus comprising a scaffold including a platform and two pair of leg units mounted to the platform, a utility tray, and a tray mount to which the utility tray is mounted, the tray mount being mounted to the platform for pivotable movement relative thereto to pivot the utility tray between an upright position in which the utility tray is elevated higher than the scaffold for use by a person on the platform and a collapsed position in which the utility tray is positioned next to the platform wherein the pairs of leg units are constructed to remain stationary with respect to the platform as the tray moves to and from the upright and collapsed positions.

* * * * *